United States Patent [19]

Smith, Jr.

[11] 3,991,772

[45] Nov. 16, 1976

[54] METHODS OF AND APPARATUS FOR EXPANDING TOBACCO

[75] Inventor: Horace L. Smith, Jr., Richmond, Va.

[73] Assignee: Smitherm Industries, Inc., Richmond, Va.

[22] Filed: Aug. 14, 1973

[21] Appl. No.: 388,271

Related U.S. Application Data

[60] Division of Ser. No. 321,226, Jan. 5, 1973, which is a continuation of Ser. No. 78,809, Oct. 7, 1970, abandoned.

[52] U.S. Cl. ..... 131/138; 131/140 P

[51] Int. Cl.[2] ..... A24F 3/18

[58] Field of Search ..... 131/140–144, 131/2, 137, 138; 34/5, 92

[56] References Cited

UNITED STATES PATENTS

| | | | |
|---|---|---|---|
| 3,085,012 | 4/1963 | Wayne | 99/81 |
| 3,233,333 | 2/1966 | Oppenheimer | 131/140 P UX |
| 3,445,247 | 5/1969 | Baerwald | 99/199 |
| 3,500,834 | 3/1970 | Taylor et al. | 131/140 |
| 3,667,135 | 6/1972 | Rowell | 34/92 |
| 3,704,716 | 12/1972 | Abbott et al. | 131/140 P |
| 3,740,860 | 6/1973 | Smith, Jr. | 43/92 |

FOREIGN PATENTS OR APPLICATIONS

| | | | |
|---|---|---|---|
| 409,660 | 2/1925 | Germany | 131/138 |
| 1,815,169 | 7/1969 | Germany | 131/140 P |

*Primary Examiner*—Robert W. Michell
*Assistant Examiner*—V. Millin
*Attorney, Agent, or Firm*—Strauch, Nolan, Neale, Nies & Kurz

[57] ABSTRACT

Methods of and apparatus for expanding tobacco in which the tobacco is heated and/or moistened to increase the elasticity of the cell walls and then subjected to a vacuum to convert moisture in the tobacco cells to vapor and effect an expansion in the volume of the moisture and a consequent distention of the cell walls to increase the size of cells. The tobacco is then frozen and dried in vacuo to remove at least part of the remaining water without significant alteration in the expanded structure of the tobacco.

8 Claims, 2 Drawing Figures

METHODS OF AND APPARATUS FOR EXPANDING TOBACCO

Figure 1:
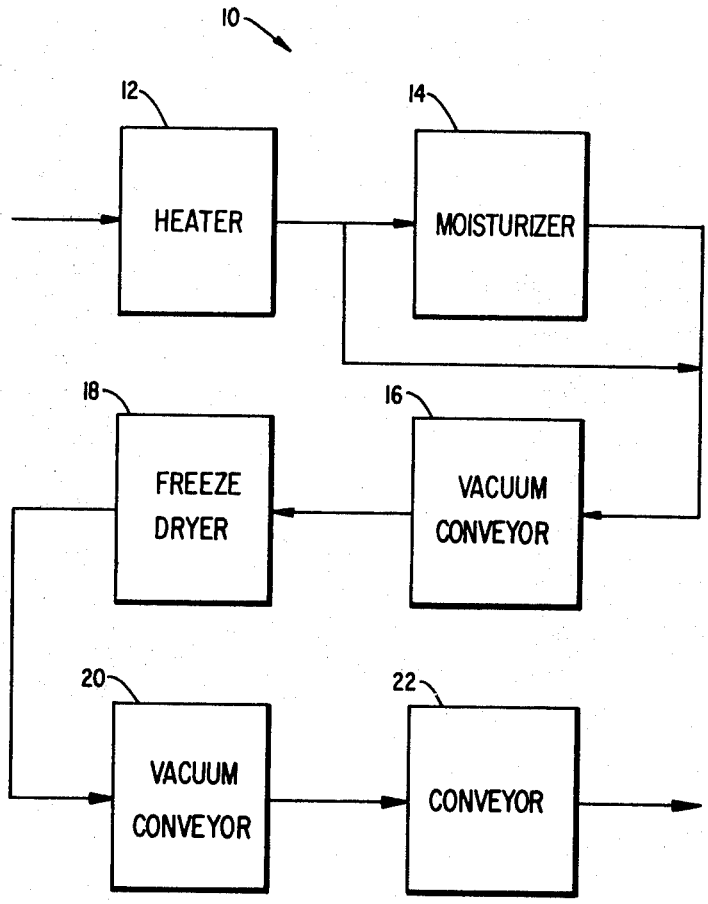

This application is a division of application Ser. No. 321,226 filed Jan. 5, 1973. The latter is a continuation of application Ser. No. 78,809 filed Oct. 7, 1970, which has been abandoned.

This invention relates to the treatment of tobacco and, more particularly, to the provision of novel improved methods of and apparatus for converting tobacco to an expanded form.

One of the desired characteristics of cigarette tobacco is that the tobacco have a high percentage of voids. This minimizes the resistance to the flow of air through the tobacco, making it easier to draw on the cigarette.

Also, as a tobacco having a high percentage of voids burns, an excess of air over that needed for combustion is present in the combustion zone. The excess air reduces the temperature of the combustion products, providing the desired "cool smoke."

Yet another advantage of a cigarette tobacco having a high percentage of voids is that the per cigarette content of nicotine and tars is low. Consequently, cigarettes made from such tobacco are safer to smoke than those made from tobacco having a lower void content.

Another desired characteristic of cigarette tobacco is that it have a high degree of structural integrity. This is necessary to produce the desired firm cigarette in contrast to one which is soft or loosely filled.

Conventionally, tobacco intended for cigarettes is shredded into narrow strips to make the void content in the body of tobacco contained in a cigarette as high as possible. However, conventionally produced shreds of tobacco are relatively limp and weak. When a body of tobacco constituted of such shreds is compressed to the extent required to produce an acceptably firm cigarette, the void content is reduced to a level well below that which it would be preferable to employ. In other words, the physical characteristics of conventional cigarette tobaccos are such that the goal of high void content is incompatible with that of firmness.

It is also desirable that cigarette tobacco have as high a filling power as possible. That is, it is desired that the physical characteristics of the tobacco be such that a maximum number of cigarettes can be made from a given weight of tobacco since tobacco is purchased on a price per weight basis.

I have now discovered that cigarette tobacco having a high void content, a high degree of structural integrity, and high filling power can be produced by subjecting conventionally processed tobacco to a process in which the tobacco is heated and/or moistened to increase the elasticity of the cell walls, subjected to a vacuum to convert moisture in the tobacco to vapor and effect an expansion in the size of the cells, frozen, and dried in vacuo to remove at least part of the water remaining in the tobacco.

Because of the increase in cell size which results, tobacco produced in the manner just described has a higher void content than conventional cigarette tobacco. Also, by expanding the cell size, the thickness of the tobacco structure is increased, making it stiffer than conventional cigarette tobacco. Consequently, a firm cigarette can be made from tobacco treated by my novel technique without the necessity of compressing the tobacco to the heretofore required extent. Accordingly, not only is the initial void content higher, but the extent to which the void content is reduced in manufacturing the cigarette is substantially decreased.

This results in cigarettes having a much higher void content than those made from conventional tobacco and the advantages which flow from high void content. In addition, because of its initial higher void content and the reduction in compression required to form a firm cigarette, tobacco treated in accord with the present invention has higher filling power than conventional cigarette tobacco; that is, a larger number of cigarettes can be made from a given weight of tobacco.

Various techniques for expanding of puffing tobacco have heretofore been proposed. Exemplary are those described in U.S. Pat. Nos. 1,789,434 issued Jan. 20, 1931; 2,344,106 issued Mar. 14, 1944; 2,739,599 issued Mar. 27, 1956; 3,409,022 3,409,023, 3,409,027, and 3,409,028 issued Nov. 5, 1968; 3,425,425 issued Feb. 4, 1969; and 3,524,451 and 3,425,452 issued Aug. 18, 1970. However, to my knowledge, no one has heretofore developed a process of expanding tobacco which has the dual advantages of the process described above—increase in void content and increase in the physical strength of the product.

The preferred apparatus for processing tobacco in accord with the present invention is of the continuous type and includes a vacuum conveyor into which conventional tobacco is introduced after the tobacco is first heated and/or moistened to increase the elasticity of the cell walls. In this conveyor the tobacco is expanded by converting part of the moisture in it to vapor. As mentioned above, this increases the volume of fluid in the cells of the tobacco, thereby distending the walls of the cells and increasing their size. The tobacco is then cooled by auto-refrigeration while it is still in the vacuum conveyor to freeze the water remaining in the tobacco. Freezing the tobacco keeps the cell walls from shrinking back to their original, unexpanded size.

From the vacuum conveyor the frozen tobacco passes into a vacuum chamber where water is sublimed from the tobacco by the application of radiant energy until the moisture content of the tobacco is reduced to the desired level. As the tobacco passes through the freeze dryer it is periodically turned or tumbled or otherwise agitated to expose different surfaces of the tobacco to the radiant heat so that the tobacco will dry in a uniform fashion.

The use of freeze drying to dry the expanded tobacco is also an important part of the present invention. By employing this technique, shrinkage of the cell walls is again avoided. Consequently, the dried product has the same desired expanded structure that the tobacco has at the end of the step in which it is expanded.

From the freeze dryer the tobacco passes into a second vacuum conveyor. In this conveyor the pressure on and temperature of the tobacco are increased to the ambient levels. As this occurs, any ice remaining in the tobacco melts and diffuses through the treated tobacco, increasing its moisture content to the desired level. The tobacco is then discharged from the vacuum conveyor to complete the process.

One important and primary object of the present invention resides in the provision of novel improved methods of and apparatus for producing tobacco having a higher void content than conventional cigarette tobacco.

Another important and primary object of the invention is the provision of novel methods of and apparatus for producing tobacco which has greater strength or structural integrity than conventional cigarette tobacco.

Yet another related important and primary object of the invention is the provision of novel, improved methods of and apparatus for producing tobacco which has greater filling power than conventional cigarette tobacco.

An important additional and primary object of the invention resides in the provision of novel, improved processes of and appparatus for producing expanded tobacco.

A related and important but more specific object of the invention resides in the provision of methods of and apparatus for expanding tobacco in which the tobacco is heated and/or moistened to increase the elasticity of the cell walls, subjected to a vacuum to convert moisture in the tobacco to vapor and effect an expansion in the size of the cells, frozen, and dried in vacuo to remove at least part of the water remaining in the tobacco without significant alteration of the expanded structure of the tobacco.

Figure 2:
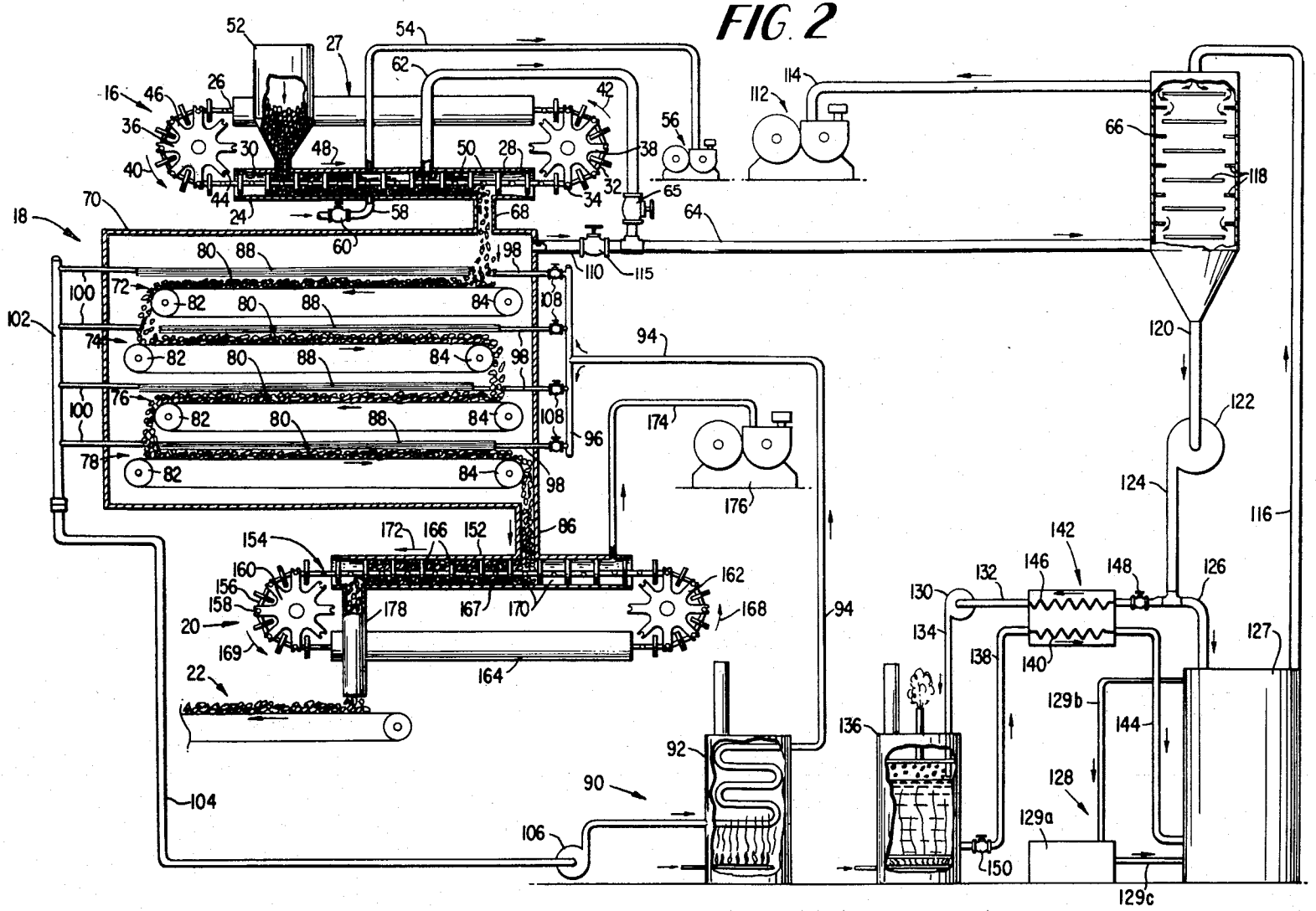

Other important objects and features and further advantages of the present invention will become apparent from the appended claims and as the ensuing detailed description and discussion of the invention proceeds in conjunction with the accompanying drawing in which:

FIG. 1 is a flow diagram of apparatus for treating tobacco in accord with the principles of the present invention; and FIG. 2 is a partially diagrammatic illustration of certain major components of the apparatus of FIG. 1.

As discussed briefly above, in the novel process of expanding tobacco described herein the tobacco is first heated or moistened or preferably both heated and moistened to increase the elasticity of the walls of the cells in the tobacco. Cured tobacco has a very low moisture content and is very brittle. In this state the tobacco can not be satisfactorily expanded as the cells will simply rupture instead of distending. Attempts to expand tobacco in the typical cured state typically result not only in a low degree of expansion but in considerable shattering and a consequent production of unusable fines.

As the temperature and moisture content of the tobacco are increased, gums, oils and other constituents become less viscous; and the walls of the tobacco cells become more flexible. The tobacco cells can then be expanded without rupturing the walls of the cells.

Both the temperature to which the tobacco is heated and the level to which its moisture content is adjusted will vary considerably, depending upon a number of factors. These include the extent to which the tobacco is to be expanded; the physical form of the tobacco—leaves (which include stems and veins); strips (leaves without veins); or cut filler (strips shredded for cigarette making and usually mixed with particles of stems and veins); the particular variety or blend being processed; and others. The tobacco may, however, be heated to temperatures up to 170° F. since even the last robust tobaccos can be heated to this temperature for the limited times involved without impairment of flavor or color. Nevertheless, in a typical application of the invention, a somewhat lower temperature (130°–150° F.) will preferably be employed.

The addition of even large amounts of water to tobacco for short periods of time does not appear to have a detrimental effect on the tobacco although excessive water may make the tobacco difficult to handle. Accordingly, there does not appear from this point-of-view to be a critical upper limit on the level to which the moisture content of the tobacco is increased in the initial steps of the tobacco expanding process I have intended. However, in a typical application of the invention, it will not prove necessary to add to the tobacco more than 0.15–0.2 pounds of water per pound of tobacco.

The next step in the novel process I have invented is to rapidly reduce the pressure on the heated and/or moistened tobacco to a level sufficiently low that a part of the moisture in the cells of the tobacco will vaporize. As this occurs, the volume of moisture increases enormously. As a consequence, the walls of the cells are distended, expanding the size of the cells.

The level to which the pressure on the tobacco is reduced is a parameter which will vary from application-to-aplication of the invention. In a typical application, however, the pressure on the tobacco will be reduced to on the order of one pound per square inch absolute to generate the vapor required for expansion of the tobacco.

The vaporization of the moisture in the tobacco is accompanied by a decrease in the temperature of the tobacco since the tobacco and the moisture it contains supply the latent heat of vaporization. In some cases this temperature decrease may be sufficiently large to decrease the elasticity of the cell walls to an undesirable extent. Also, the evaporation of moisture from the tobacco in the expansion step may reduce the moisture content to an undesirably low level.

In such cases steam is added to the tobacco in the novel process I have intended. The steam keeps the temperature of the tobacco at the desired level and also reduces the loss of moisture from the expanding tobacco. The temperature and pressure of the steam used for this purpose as well as the amount which is used will of course depend on a number of factors including the amount of heat required to keep the tobacco at the desired temperature level, the moisture content of the steam, etc.

At the end of the expansion step, the tobacco is still in a relatively plastic state; i.e., the cell walls are still relative elastic. To keep the tobacco from shrinking back toward its unexpanded state, the moisture remaining in the tobacco is promptly frozen.

The freezing step is accomplished by further reducing the pressure on the tobacco, typically to a pressure on the order of 0.02 to 0.04 psia. At such pressures water can exist only in the form of ice at the temperature which the tobacco will typically have. Accordingly, as the pressure on the tobacco is reduced to these levels, ice is formed in the cells of the tobacco to keep them from shrinking. Also, the gums, oils, and similar constituents in the tobacco become extremely viscous and the cell walls lose elasticity, further assisting in keeping the tobacco in the expanded state.

Moisture must be removed from the frozen tobacco to reduce its moisture content to the level which is desired in the expanded tobacco. This is accomplished in accord with the present invention by keeping the frozen tobacco under a high vacuum and heating it, preferably by the application of radiant heat. This causes moisture remaining in the tobacco to sublimate; i.e., to pass directly from the solid to the gaseous state.

The advantage of drying the expanded tobacco in the manner just described is that the removal of excess moisture can be accomplished without significant alteration in the expanded characteristics of the tobacco. Accordingly, the use of the just described technique (commonly referred to as "freeze drying") to dry the expanded tobacco is considered an important part of the present invention.

The tobacco is preferably turned or tumbled periodically during the drying step. This promotes uniformity in the exposure of the different surfaces of the tobacco to the radiant heat and, consequently, uniform drying.

Normally, it is desired that the expanded and dried tobacco have a definite, predetermined moisture content; i.e., that it not be reduced to a bone dry state. This keeps it from being too brittle, reduces its burning rate, etc. Accordingly, the freeze drying step is normally terminated while there is still some ice in the tobacco. The tobacco is then returned to ambient conditions. As this occurs, the ice melts, and the resulting water diffuses through the tobacco, increasing its moisture content to the desired level.

Referring now to the drawing, FIG. 1 illustrates in block diagram form apparatus 10 for expanding tobacco in accord with the principles of the present invention. The first major component of apparatus 10 is a heater 12 in which the temperature of the tobacco to be expanded is increased.

This is to lower the viscosity of gums, oils, and similar constituents of the tobacco and to increase the flexibility of the tobacco cell walls so that the tobacco may be expanded without rupturing or shattering the walls of the tobacco cells.

After heating, the tobacco may be expanded. Typically, however, it will first be delivered to a moisturizer 14 to increase the moisture content of the tobacco. As discussed above, this also increases the elasticity of the walls of the tobacco cells, making the tobacco easier to expand.

From heater 12 (or moisturizer 14), the tobacco is delivered to a vacuum conveyor 16 in which the now elastic tobacco is expanded and then frozen to prevent it from shrinking toward its unexpanded state. The vacuum conveyor then delivers the frozen tobacco to a freeze dryer 18, where excess moisture is removed from the tobacco. The dried tobacco is discharged into a second vacuum conveyor 20 in which the temperature of and the pressure on the tobacco increases to the ambient level. As this occurs, any ice remaining in the expanded and dried tobacco melts; and the water diffuses throughout the tobacco, increasing its moisture content to the desired level. From this vacuum conveyor, the tobacco is discharged onto a conventional transfer conveyor 22, which conveys the dried, expanded tobacco to a cigarette making machine or other station (not shown) for further processing.

Heater 12 and moisturizer 14 may be of any desired construction and may, in fact, advantageously be combined into a single unit in many applications of the present invention. Suitable units capable of concomitantly heating and increasing the moisture content of tobacco are disclosed in my prior U.S. Pat. Nos. 2,086,446 issued July 6, 1937; 2,124,012 issued July 19, 1938; and 2,217,935 issued Oct. 15, 1940, and in U.S. Pat. No. 2,739,599 issued Mar. 27, 1956.

Since suitable devices for heating tobacco and for increasing its moisture content have heretofore been described in the patent literature and as the specific nature of these components is not critical in the practice of the present invention, they will not be described further herein.

As indicated above, the heated and/or moisturized tobacco flows from heater 12 or moisturizer 14 to vacuum conveyor 16 in which the tobacco is first expanded and then frozen to eliminate shrinkage. Referring now to FIG. 2, the preferred form of conveyor includes an elongated, cylindrical casing 24 through which an endless, flexible chain 26 extends. Chain 26 also extends through an elongated cylindrical guide 27 disposed in parallel, spaced relationship to casing 24.

Fixed to endless chain 26 at substantially equidistantly spaced intervals are pistons 28 which are circular discs or flights configured to engage the inner wall 30 of casing 24. Peripheral seals on flights 28 (not shown) will generally be employed to keep gas from leaking past the seals. Preferably, the distance between pistons 28 is so related to the length of casing 24 that there are always plural pistons in the casing. This provides plural seals between vacuum dryer 18 and the surrounding environment to minimize leakage into the freeze dryer. Also, the interior of casing 24 may be coated with Teflon or other material having a low coefficient of friction or otherwise treated to reduce sliding friction between casing 24 and the flights 28 of conveyor 16.

Belt 26, which consists of links 32 connected by pivot or hinge pins 34, is trained around sprocket members 36 and 38 at opposite ends of casing 24. The sprockets are rotated in the directions indicated by arrows 40 and 42 in FIG. 2 by a drive arrangement of appropriate construction (not shown). As the sprockets rotate, the connecting pins 34 of belt 26 are drivingly engaged in recesses 44 at the outer ends of sprocket arms 46. Accordingly, as they revolve, the sprockets propel drive chain 26 and flights 28 through cylindrical casing 24 in the direction indicated by arrow 48 in FIG. 2.

It will be apparent from FIG. 2 and from the foregoing description that pistons 28 cooperate with casing 24 to form a series of moving, substantially gastight compartments 50. These compartments are filled with the tobacco to be expanded after it has been heated and/or moisturized from a hopper 52 which communicates with the interior of casing 24 adjacent the feed end of the latter.

Intermediate its ends, the interior of casing 24 is connected through a conduit 54 to a vacuum pump 56. Accordingly, as each compartment 50 moves through casing 24, communication is established between it and vacuum pump 56 to reduce the pressure on the tobacco in the compartment.

As discussed above, the pressure is reduced to a sufficiently low value that part of the moisture in the tobacco will be converted to water vapor. This enormously increases the volume of the moisture; and the vapor accordingly distends the more-or-less elastic walls of the tobacco cells, thereby expanding the size of the cells. By controlling the speed of conveyor belt 26, the rate of conversion of the moisture in the tobacco to water vapor can be regulated so that the vapor will be formed fast enough to effect the desired expansion but not so fast as to explode the tobacco.

The vaporization is accompanied by a drop in the temperature of the expanding tobacco due to the loss of latent heat of vaporization. As discussed above, this may in some cases result in an unacceptable decrease in the elasticity of the tobacco. It was also pointed out that the temperature drop can be offset by adding steam to the tobacco as it expands. Provision is made for this in the apparatus shown in FIG. 2. More specifically, a steam line 58 is connected to the interior of casing 24 at approximately the same location or station as vacuum line 54. A valve 60 in steam line 58 can be opened to admit steam to the interior of the casing as needed.

In addition to water vapor, non-condensible gases (primarily air) will be present in each compartment 50 during the expanding step. As the vapor is formed and exits from casing 24 through vacuum line 54, it entrains the non-condensible gases, evacuating them from the compartment 50 in communication with the vacuum line through the latter.

Referring still to FIG. 2, downstream of the station at which vacuum line 54 and steam line 58 communicate with the interior of casing 24, a second vacuum line 62 is connected to the interior of the casing. Vacuum line 62 is connected through a second vacuum line 65 to a condenser 66 which will be described in more detail later. Vacuum line 62 is provided so that the pressure on the non-expanded tobacco can be further decreased. Valve 65 in line 62 can be adjusted to regulate the extent to which the pressure on the tobacco is reduced.

More specifically, as discussed above, after the expansion step is completed, the pressure on the expanded tobacco is reduced to a level at which additional moisture will convert into vapor. This extracts additional heat from the tobacco, causing the remaining moisture to freeze. The freezing of the expanded tobacco eliminates shrinkage by increasing the viscosity of gums, oils, and other constituents in the tobacco; by reducing the flexibility of the tobacco cell walls; and by forming ice in the cells of the tobacco to keep them from contracting.

At the right-hand end of conveyor casing 24 as shown in FIG. 2, the expanded, frozen tobacco is discharged from the casing through a transfer conduit 68 into freeze dryer 18. As shown in FIG. 2 the freeze dryer includes a generally gastight casing 70 housing a series of conventional, horizontally oriented, vertically spaced apart conveyors 72, 74, 76 and 78. Each of these conveyors includes an endless belt 80 trained around rollers 82 and 84, one or both of which may be driven by an appropriate drive arrangement (not shown).

The three lower conveyors 74, 76 and 78 are so positioned relative to each other and to conveyor 72 that the feed end of each conveyor is positioned below the discharge end of the conveyor thereabove. Accordingly, the expanded, frozen tobacco falls through transfer conduit 68 onto the feed end of conveyor 72. It proceeds along conveyor 72 and then passes over the discharge end of the latter onto the feed end of conveyor 74, proceeds along the latter, falls onto the feed end of conveyor 76, etc. Finally, the material is discharged from conveyor 78 through transfer conduit 86 into the discharge vacuum conveyor 20.

The use of the multiple conveyor arrangement just described is considered an important part of the invention. This causes the tobacco to be periodically tumbled or agitated as it moves through dryer 18, exposing fresh surfaces to radiant heat emanating from radiators 88 disposed closely adjacent the upper runs of the conveyors. This promotes uniform exposure of the tobacco surfaces to the radiant heat and, consequently, uniform drying of the tobacco.

Radiators 88 may be of any desired type such as, for exanple, those disclosed in my U.S. Pat. Nos. 3,262,494 issued July 26, 1966; 3,285,514 issued Nov. 15, 1966; and 3,305,011 issued Feb. 21, 1967.

The interior of vacuum vessel 18 is maintained at a pressure typically on the order of 0.04 inch of mercury absolute. At this pressure the excess moisture in the frozen tobacco will, upon the application of heat from radiators 88, pass directly from the frozen state to the vapor state; i.e., sublime, at temperatures of −20° F. or higher. The heat from radiators 88 increases the tobacco temperature to a higher level to effect sublimation of the excess moisture from the frozen tobacco.

This method of removing excess moisture is an important part of the present invention since it permits the moisture to be removed without significant shrinkage of the expanded tobacco. By the time the tobacco is dried to a typical final moisture content, elasticity of the cell walls of the tobacco is reduced and the viscosity of the gums, oils, and the like increased to such an extent that shrinkage is no longer a problem.

Radiators 88 are heated by circulating a fluid, preferably liquid, heat transfer medium through them. Suitable heat transfer liquids, capable of being heated to temperatures as high as 800° F. without an unacceptably high rate of degradation, are disclosed in my U.S. Pat. No. 3,236,292 issued Feb. 22, 1966.

Radiators 88 are incorporated in a liquid heating and circulation system 90. In addition to the radiators, this system includes a heating unit 92. The heating unit is connected to the radiators by supply conduit 94, supply header 96, and branch supply conduits 98 and by branch return conduits 100, return header 102, and main return conduit 104. A pump 106 in main return conduit 104 circulates the heat transfer medium through the closed system just described. Flow through each of the radiators 88 is regulated by a valve 108 in the associated branch supply conduit 98 so that the heat from each radiator to the tobacco on the associated conveyor can be independently controlled.

The heating system just described will in actual practice include a number of additional components as will be apparent to those versed in the arts to which this invention relates. However, as such components are not part of the present invention and as they are described in U.S. Pat. No. 3,236,292 and elsewhere, they will not be referred to further herein.

It is necessary to continuously remove the evaporated moisture from vacuum vessel 70 since, at typical operating pressures and temperatures, each pound of water removed from the tobacco occupies several thousand cubic feet. One form of apparatus which may be employed for this purpose includes the condenser 66 referred to above. The condenser is connected to vacuum vessel 70 by the above-mentioned conduit 64 and by conduit 110 and to a vacuum pump 112 by conduit 114. A valve 115 regulates the flow through conduit 110 to the condenser.

Vacuum pump 112, which is also used to pump down vacuum vessel 70 when the system is started up, draws the accumulated water vapor from vacuum vessel 70 through conduits 110 and 64 and upwardly through condenser 66, where it is absorbed by a refrigerated sorbent such as an aqueous lithium chloride solution. The sorbent is pumped from a conduit 116 into the upper end of condenser 66 and flows downwardly through the condenser over interleaved horizontal baffles 118.

From the lower end of the condenser the sorbent, heated and diluted by absorbed water vapor, flows through conduit 120 into pump 122, which circulates the diluted sorbent through conduits 124 and 126 into the cooler 127 of refrigeration apparatus 128, which also includes a refrigeration producer 129*a* connected to cooler 127 by conduits 129*b* and 129*c*. The refrigeration apparatus may be of any appropriate type such as the ammonia compression system disclosed in my U.S. Pat. No. 2,515,098 issued July 11, 1959. In cooler 127 the lithium chloride solution is cooled for recirculation to condenser 66. As the refrigeration system is per se not part of the present invention and as suitable systems can be readily selected by those familiar with the relevant arts, this sytem will not be described further herein.

A second, smaller circulating pump 130 continuously draws a portion of the dilute solution from conduit 124 and delivers it through conduits 132 and 134 to a sorbent concentrator or reboiler 136, which may be of the type described in my U.S. Pat. No. 2,515,098. Here, excess water is boiled off the sorbent solution to increase its concentration.

From reboiler 136, the sorbent flows through conduit 138, a coil 140 in heat exchanger 142, and conduit 144 back into refrigeration unit cooler 127, where it is cooled for recirculation to condenser 66. As the hot, concentrated sorbent flows through heat exchanger 142, it gives up otherwise unusable sensible heat to dilute sorbent flowing to reboiler 136 through a coil 146 disposed in heat exchanger 142 in heat transfer relationship to coil 140. Circulation of the sorbent from main return conduit 124 through the reboiler and flow of the concentrated sorbent from the reboiler through heat exchanger 142 to refrigeration unit 127 are controlled by valves 148 and 150 in conduits 132 and 138, respectively.

The details of the vapor removal system just described are not critical in the practice of the present invention. For this reason and because appropriate systems are discussed in detail in my U.S. Pat. No. 2,515,098 and in my copending application Ser. No. 61,772 filed Aug. 6, 1970 (now U.S. Pat. No. 3,621,587 issued Nov. 23, 1971), both of which are hereby incorporated by reference, this system will not be discussed further herein.

Referring again to FIG. 2, the vacuum conveyor 20 into which the dried tobacco is transferred from freeze dryer 18 is of essentially the same type as the vacuum conveyor 16 discussed above. This conveyor includes a cylindrical casing 152 through which an endless belt 154 consisting of links 156 connected by hinge pins 158 extends. Belt 154 also extends around sprockets 160 and 162, which drivingly engage the belt in the manner described above, and through a cylindrical guide 164.

Fixed to endless belt 154 at generally equidistantly spaced intervals are pistons 166 in the form of circular discs or flights which are configured to match the inner wall 167 of casing 152 and carry peripheral sealing members (not shown) to provide generally gastight seals between the flights and the interior of the casing. Also, as in the case of conveyor 24 and for the same reasons, the conveyor is preferably constructed so that there are always plural pistons in casing 152 to isolate freeze dryer 18 from the surrounding environment. And, as in the case of conveyor 16, the interior of the casing may be coated with Teflon or the like to reduce sliding friction between the casing and conveyor flights 166.

Sprockets 160 and 162 are rotated in the directions indicated by arrows 168 and 169 in FIG. 2 by a suitable drive mechanism (not shown). Accordingly, conveyor flights 166 cooperate with the interior of casing 152 to form a series of pockets 170 which move through casing 152 in the direction indicated by arrow 172 in FIG. 2. Compartments 170 are filled with dried tobacco from transfer conduit 86 and carry the tobacco through the conveyor from right to left as shown in FIG. 2.

In a typical application of the present invention, only a part of the moisture present in the tobacco is removed in freeze dryer 18, the remaining moisture being in the form of ice as the tobacco is transferred into discharge conveyor 20. As the tobacco is moved through conveyor 20 in pockets 170, the pressure on and temperature of the tobacco is increased. The remaining ice accordingly melts, and the resulting water diffuses, throughout the tobacco. In this manner, the moisture content of the expanded product can be adjusted to any desired level.

As shown in FIG. 2, the interior of casing 152 is connected through vacuum line 174 to a vacuum pump 176 adjacent the right-hand end of the casing. Vacuum pump 176 keeps air and other non-condensibles entering casing 152 at the right-hand end thereof from flowing into the freeze dryer 18.

From the left-hand end of conveyor 20 the expanded tobacco is discharged through conduit 178 onto transfer conveyor 22. As discussed above, this conveyor transfers the expanded tobacco to a cigarette making machine or other station for further processing.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Apparatus for expanding tobacco, which comprises means for heating and/or increasing the moisture content of the tobacco to increase the elasticity of the walls of the cells of said tobacco; means for thereafter reducing the pressure on said tobacco to a level sufficiently low to convert a part of the moisture in said tobacco into vapor and increase its volume to thereby expand the size of the tobacco cells which comprises conduit means, means disposed within said conduit means for dividing the interior thereof into a plurality of mutually isolated compartments, means for introducing the heated and moistened tobacco into said compartments at a first location, means for displacing said compartment forming means in said conduit means, a vacuum producer, and means connecting said vacuum producer to the interior of said conduit means at a second location spaced from the first location, whereby said compartments can be filled with the heated and moistened tobacco and then advanced into communication with the vacuum producer to effect the desired reduction in the pressure on said tobacco; means for freezing the expanded tobacco; and means for thereafter drying said tobacco in vacuo, whereby the moisture content of said tobacco can be reduced without significant shrinkage in the size of said cells.

2. The apparatus of claim 1, together with means for further reducing the pressure in each of said compartments after the expansion of the tobacco therein to a level sufficiently low to effect the freezing of said tobacco by autorefrigeration.

3. The apparatus of claim 1, together with means for supplying steam to said compartment to offset the drop of temperature therein which accompanies the flashing into vapor of the water contained in the tobacco in the compartment as the pressure thereon is reduced.

4. Apparatus for expanding tobacco, which comprises means for heating and increasing the moisture content of the tobacco to increase the elasticity of the walls of the cells of said tobacco; means for thereafter reducing the pressure on said tobacco to a level sufficiently low to convert a part of the moisture in said tobacco into vapor and increase its volume to thereby expand the size of the tobacco cells which comprises conduit means, an endless member extending through said conduit means, a plurality of pistons fixed to said endless member in spaced apart relationship, said pistons being sealingly engageable with the inner wall of said conduit means, means for advancing said endless member to thereby move said pistons through said conduit means, means for introducing the heated and moistened tobacco into said conduit means between successive pistons at a first location, a vacuum producer, and means connecting said vacuum producer to the interior of said conduit means at a second location spaced from the first location in the direction of piston movement, whereby said conduit means and the pistons advancing therethrough define a succession of compartments which are filled with the heated and moistened tobacco and then advanced into communication with the vacuum producer to effect the desired reduction in the pressure on said tobacco; means for freezing the expanded tobacco by autorefrigeration; and means for thereafter drying said tobacco in vacuo, whereby the moisture content of said tobacco can be reduced without significant shrinkage in the size of said cells.

5. The apparatus of claim 4, together with means for supplying steam to said compartments as the pressure therein is reduced to prevent excessive cooling of said tobacco and a consequent excessive loss of moisture therefrom.

6. The apparatus of claim 4, wherein the means for freezing the expanded tobacco comprises means communicating with the interior of the conduit at a third location spaced from the second location in the direction of movement of said pistons for further reducing the pressure on said expanded tobacco to a level sufficiently low to effect further evaporation of the moisture in said tobacco and a consequent reduction of the temperature of the remaining moisture in said tobacco to at least its freezing point.

7. Apparatus for expanding tobacco, which comprises means for heating and/or increasing the moisture contact of the tobacco to increase the elasticity of the walls of the cells of said tobacco; means for thereafter reducing the pressure on said tobacco to a level sufficiently low to convert a part of the moisture in said tobacco into vapor and increase its volume to thereby expand the size of the tobacco cells; means for freezing the expanded tobacco; means for thereafter drying said tobacco in vacuo so that the moisture content of said tobacco can be reduced without significant shrinkage in the size of said cells, which includes a substantially gastight vacuum chamber, means for evacuating said chamber, means for transferring the frozen tobacco from said conduit means to said chamber, means for conveying the frozen tobacco through the vacuum chamber, and radiant heating means for heating the frozen tobacco as it is conveyed through the vacuum chamber to sublime at least a portion of the moisture therefrom; and means for removing the dried tobacco from the vacuum chamber while maintaining a substantial degree of isolation between the interior of said chamber and the surrounding environment comprising conduit means, an endless member extending through said conduit means, a plurality of pistons fixed to said endless member in spaced apart relationship, said pistons being sealingly engageable with the inner wall of said conduit means; means for advancing said endless member to thereby move said pistons through said conduit means; means for introducing the dried tobacco into said conduit means between successive pistons; and means for evacuating said conduit means communicating with the conduit means, said conduit means being sufficiently long relative to the distance between said pistons that there are at all times a plurality of pistons in said conduit means between the location where the dried tobacco is introduced into the conduit means and the discharge end thereof, whereby said pistons provide a plurality of seals between the said vacuum chamber and the surrounding environment.

8. Apparatus for expanding tobacco, which comprises: means for heating and/or increasing the moisture content of tobacco to increase the elasticity of the walls of the cells of said tobacco; casing means in which said tobacco can be isolated from the ambient surroundings; means for reducing the pressure on the tobacco isolated in said casing means to a level sufficiently low to convert a part of the moisture in said tobacco into vapor and increase its volume to thereby expand the size of the tobacco cells; means for supplying steam to the casing means in which the pressure on the tobacco is reduced to thereby keep the walls of the tobacco cells elastic and to keep the moisture content of the tobacco at an acceptably high level; means operable while said tobacco is still isolated from the ambient surroundings in said casing means as aforesaid for further reducing the pressure on said tobacco sufficiently low to freeze said tobacco and thereby inhibit it against shrinking toward its unexpanded configuration; and means for thereafter drying said tobacco in vacuo, whereby the moisture content of said tobacco can be reduced without significant shrinkage in the size of said cells.

* * * * *

UNITED STATES PATENT OFFICE

CERTIFICATE OF CORRECTION

Patent No. 3,991,772 Dated November 16, 1976

Inventor(s) Horace L. Smith, Jr.

It is certified that error appears in the above-identified patent and that said Letters Patent are hereby corrected as shown below:

Column 3, line 11, change "appparatus" to --apparatus--.

Column 4, line 7, change "intended" to --invented--.

Column 4, line 21, change "aplication" to --application--.

Column 4, line 36, change "intended" to --invented--.

Column 7, line 19, change "65" to --64--.

Column 8, line 2, change "exanple" to --example--.

Signed and Sealed this

Nineteenth Day of April 1977

[SEAL]

*Attest:*

RUTH C. MASON
*Attesting Officer*

C. MARSHALL DANN
*Commissioner of Patents and Trademarks*